US006406516B1

(12) United States Patent
Song et al.

(10) Patent No.: US 6,406,516 B1
(45) Date of Patent: Jun. 18, 2002

(54) METHOD FOR MAKING HIGH VOLUME REINFORCED ALUMINUM COMPOSITE BY USE OF DIPPING PROCESS

(75) Inventors: In-Hyuck Song; Yoo-Dong Hahn; Hai-Doo Kim, all of Kyungsangnam-do; Do-Kyung Kim, Daejeon, all of (KR)

(73) Assignee: Korea Institute of Machinery & Materials (KR)

( * ) Notice: Subject to any disclaimer, the term of this patent is extended or adjusted under 35 U.S.C. 154(b) by 0 days.

(21) Appl. No.: 09/846,414

(22) Filed: May 1, 2001

(30) Foreign Application Priority Data

Mar. 6, 2001 (KR) ..... 01-11347

(51) Int. Cl.[7] ..... C22C 1/00

(52) U.S. Cl. ..... 75/684; 420/590

(58) Field of Search ..... 75/415, 684; 420/590

(56) References Cited

U.S. PATENT DOCUMENTS 4,985,202 A * 1/1991 Moshier et al. ..... 420/590

* cited by examiner

*Primary Examiner*—Melvyn Andrews
(74) *Attorney, Agent, or Firm*—Cooper & Dunham LLP

(57) ABSTRACT

Disclosed are composition and a method for making a high volume reinforced Al composite by use of a dipping process. Through the method comprising mixing 20–50 wt % of exothermic reaction-causing Ti and C or Ti and B powders, 20–60 wt % of exothermic reaction-controlling diluent powders, and 5–30 wt % of infiltration-aiding Al or Al alloy powders, then preparing mixture powders; preforming the mixture powders into a predetermined shape; fitting the preformed body in a reaction container, followed by dipping in an Al melt of 700–1,100° C.; and separating the synthesized composite from the reaction container after removal from the Al melt, a high volume reinforced Al composite can be prepared from the mixture powders through such exothermic synthesis in a metal melt that reinforced particles are uniformly distributed while restraining the generation of pores. As such, the exothermic reaction-controlling diluent powders are selected from the group consisting of TiC, $TiB_2$, SiC, WC or mixtures thereof.

2 Claims, 5 Drawing Sheets

METHOD FOR MAKING HIGH VOLUME REINFORCED ALUMINUM COMPOSITE BY USE OF DIPPING PROCESS

BACKGROUND OF THE INVENTION

1. Field of the Invention

The present invention relates to a composition and a method for making a high volume reinforced aluminum (Al) composite by use of a dipping process, from powder mixture through such exothermic synthesis in a metal melt that reinforced particles are uniformly distributed while restraining the generation of pores.

2. Description of the Prior Art

Generally, conventional methods for making composite materials are classified into solid state processes using traditional powder metallurgical process; and liquid state processes, such as stir casting, squeeze casting, spray deposition, plasma process, DC casting, rheocasting, thixocasting and so on. However, the solid state processes suffer from the limitations in terms of economic efficiency and the liquid state processes have disadvantages that size of reinforcement is limited to tens of $\mu$m or larger, and to amounts of 20% or lower within composite materials.

Up to now, the method for making high volume reinforced composite, other than powder methods, has been used as a method for impregnating metal into a preformed body comprising reinforcements under pressure or no pressure. But this method suffers from the disadvantages that wettability between the reinforcement and the melt is poor so that pore problems and the like occurs.

A dipping process is characterized in that reinforced particles themselves are formed in materials as one of in-situ synthesis process and thus the size of reinforcement may be controlled, thereby uniformly distributing very fine reinforced particles of 0.1-ones of $\mu$m therein. Therefore the dipping process is possible to be called one of in-situ processes of composite materials. It is known that reinforced particles in the composite materials prepared by in-situ process have excellent interfacial properties. This is because the interfaces between matrix materials and newly formed reinforced particles are clean and continuous. Additionally, through the dipping process, final composite materials have the same shape as the preformed body, so that near net shaping can be realized.

From U.S. Pat. No. 4,710,348 (Brupbacher et al., Process for forming metal-ceramic composites), U.S. Pat. No. 5,336,291 (Nakami et al., Method of production of a metallic composite material incorporating metal carbide particles dispersed therein), and Japanese Patent Laid-Open Publication 63-83239 (Brupbacher et al., Process for forming metal-ceramic composites), it can be found that fine particles are dispersed in matrix structure through the in-situ synthesized process of composite materials.

However, in the conventional methods, Al composite having uniform particles cannot be obtained by a melt reaction, which is a exothermic reaction immediately following a synthesized process. As can be seen in FIG. 2*a*, reinforced particles of the composite prepared by the in-situ melt reaction process are heterogeneously distributed.

Conventionally, the inventors have tried to prepare a low volume fraction (10 vol % or less) composite by stirring of primary synthesized composite. In order to have homogeneously dispersed reinforced particles, primary synthesized composite is useful as a master alloy in the melt. And an extrusion process is introduced in order to obtain the uniformly redistributed reinforced particles in primarily prepared master alloy composite.

SUMMARY OF THE INVENTION

Accordingly, an object of the present invention for alleviating the problems as described above is to provide a composition for preparing a high volume reinforced Al composite from the powder mixture through such exothermic synthesis in a metal melt that reinforced particles are uniformly distributed while restraining the generation of pores.

Another object of the present invention is to provide a method for making a high volume reinforced Al composite from a preformed body formed by mixing said composition by use of a dipping process.

In accordance with an embodiment of the present invention, there is provided a composition for preparing a high volume reinforced Al composite by use of a dipping process, comprising 20–50 wt % of exothermic reaction-causing powders consisting of Ti and C or Ti and B, 20–60 wt % of exothermic reaction-controlling diluent powders, and 5–30 wt % of infiltration-aiding Al or Al alloy powders, said high volume reinforced Al composite being prepared from the powder mixture through such exothermic synthesis in a metal melt that reinforced particles are uniformly distributed while restraining the generation of pores.

Preferably, said exothermic reaction-controlling diluent powders are selected from the group consisting of TiC, $TiB_2$, SiC, WC or mixtures thereof.

In accordance with another embodiment of the present invention, there is provided a method for preparing high volume reinforced Al composite by use of a dipping process, comprising the steps of: mixing 20–50 wt % of exothermic reaction-causing powders consisting of Ti and C or Ti and B, 20–60 wt % of exothermic reaction-controlling diluent powders, and 5–30 wt % of infiltration-aiding Al or Al alloy powders, then drying, to prepare mixture powders; preforming the mixture powders into a predetermined shape; fitting said preformed body in a reaction container, followed by dipping in an Al melt of 700–1,100° C.; and separating said preformed body from the reaction container after removal from the Al melt, thereby yielding a high volume reinforced Al composite from the powder mixture through such exothermic synthesis in a metal melt that reinforced particles are uniformly distributed while restraining the generation of pores.

Preferably, said exothermic reaction-controlling diluent powders are selected from the group consisting of TiC, $TiB_2$, SiC, WC or mixtures thereof.

BRIEF DESCRIPTION OF THE DRAWINGS

The above and other objects, features and other advantages of the present invention will be more clearly understood from the following detailed description taken in conjunction with the accompanying drawings, in which:

FIG. 1*a* is a view showing a preformed body prepared by use of mixed powders;

FIG. 1*b* is a view showing the preformed body fitted in a graphite container to maintain an initial shape of the preformed body;

FIG. 1*c* is a view showing the chemical reaction of the preformed body in the metal melt through exothermic process;

FIG. 1*d* is a view showing the graphite container-removed final composite after removal from the melt;

Each of FIGS. 2*a* and 2*b* is a low magnitude sectional view of a high volume reinforced Al—TiC composite prepared by a dipping process in both cases of not adding a diluent and adding a diluent.

DETAILED DESCRIPTION OF THE INVENTION

Figure 1A:
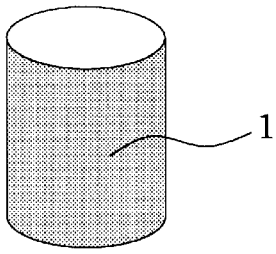
FIGS. 1*a*–1*d* are views showing preparation processes of a high volume reinforced Al composite by a dipping process of the present invention.
Figure 1B:
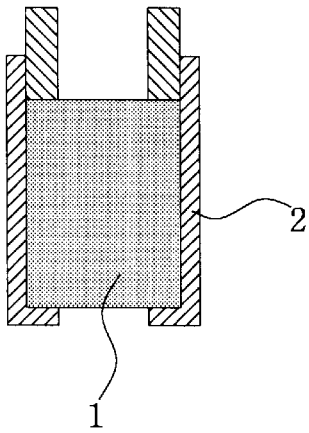
Figure 1C:
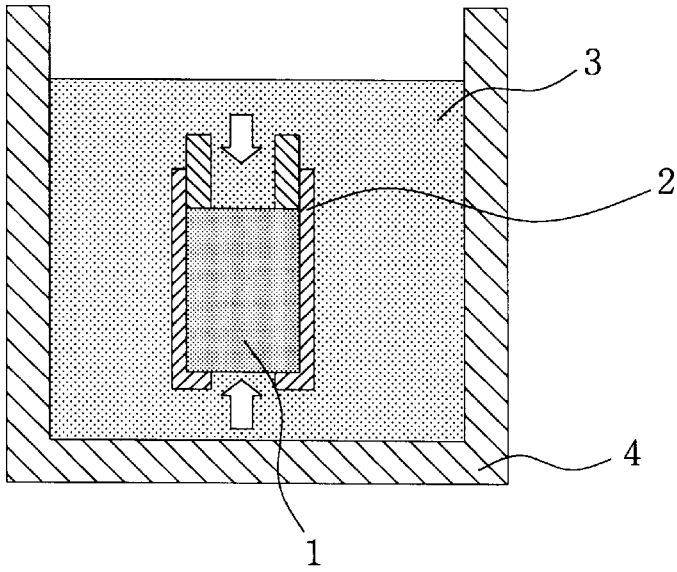
Figure 1D:
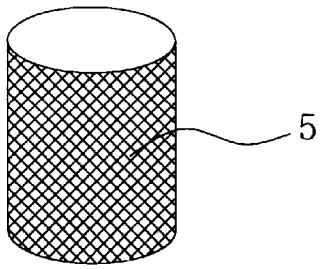
Figure 2A:
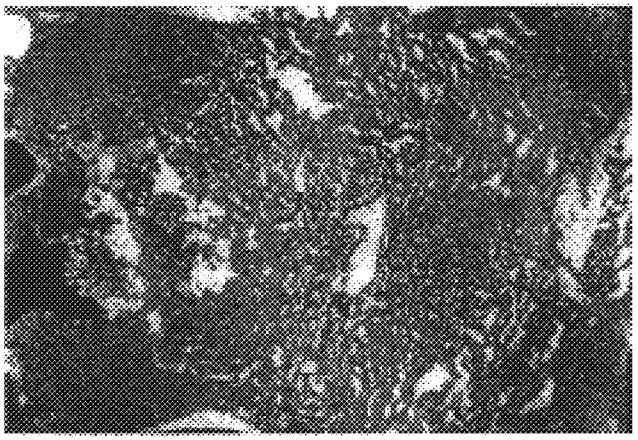
Figure 2B:
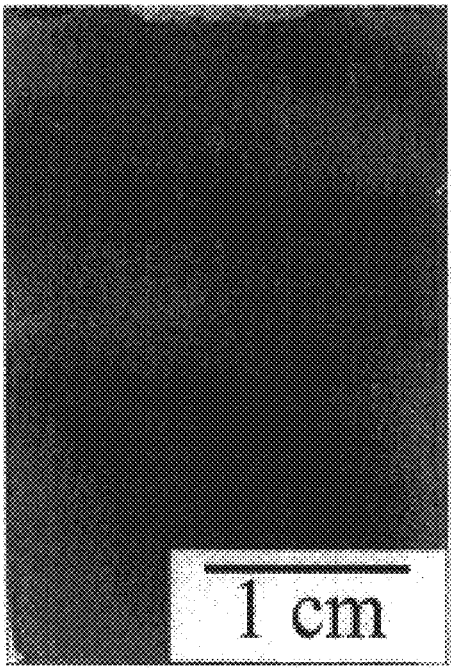
Figure 3:
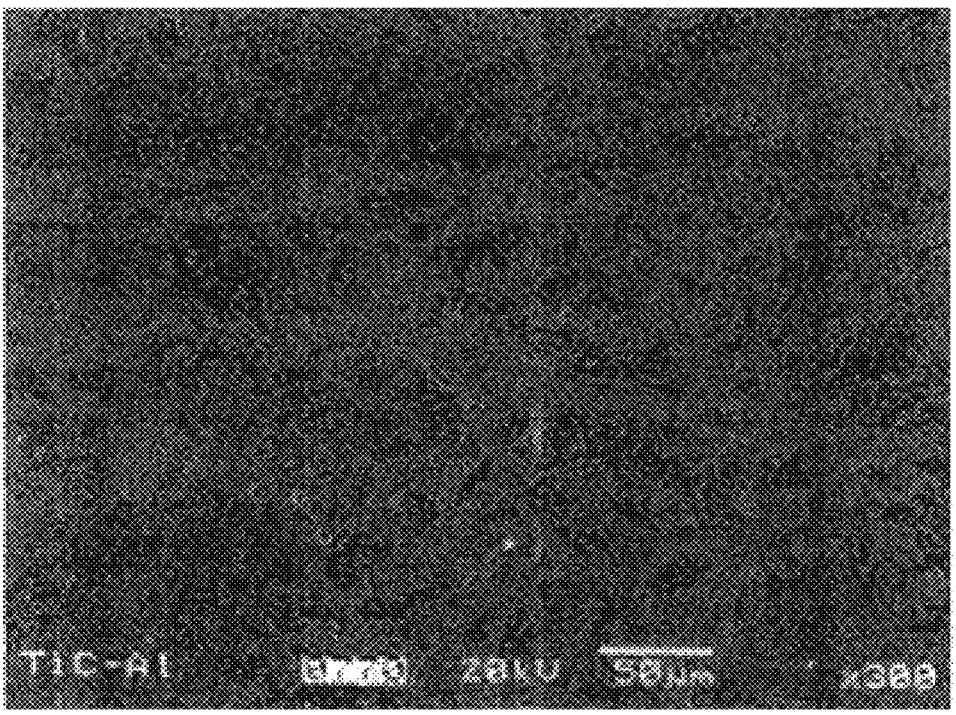
FIG. 3 is a photograph of a high magnitude section of a high volume fraction TiC reinforced Al composite prepared by a dipping process in the case of adding a diluent.

FIGS. 1*a*–1*d* show preparation processes of high volume reinforced Al composite by a dipping process, in which FIG. 1*a* shows a preformed body of mixture powders, FIG. 1*b* showing the preformed body fitted in a graphite container to maintain initial shape of the body, FIG. 1*c* showing synthesis of the preformed body in the metal melt through exothermic reaction, FIG. 1*d* showing the graphite container-removed final composite after removal from the melt, and FIG. 2*b* shows a low magnitude section of a high volume reinforced Al—TiC composite prepared by a dipping process when a diluent is added, and FIG. 3 shows a high magnitude section of a high volume TiC reinforced Al composite prepared by a dipping process when a diluent is added.

The present invention can be realized by introducing the concept that, first, an exothermic reaction-controlling diluent is mixed on preparation of the preformed body of mixture powders, and second, composition of raw materials of preformed powders (exothermic react-on powders, diluent powders, metal powders) and temperature of the melt, which are variables in the preparation process, are adjusted. The point of the preparation method is the following.

In the method for preparing a high volume reinforced composite by a dipping process, as exothermic reaction powders, 20–50 wt % of powders of suitable chemical composition for generating exothermic reaction, 20–60 wt % of diluent powders for controlling exothermic reaction, and 5–30 wt % of Al metal powders for improving wettability are mixed to prepare a preformed body. The preformed body is dried in a thermostat and then fitted into a graphite reaction container, followed by dipping in a molten metal maintained at 700–1,100° C. Ones seconds to ones minutes after the onset of the synthesized exothermic reaction in the preformed body-dipped melt, the preformed body is removed from the container.

The reason why composition of raw powder materials and temperature of the melt are Limited is as follows. As such, exothermic reaction-causing powders are exemplified by Ti and C, and the diluent powders by TiC.

(1) Composition of Raw Powder Materials a. Exothermic Reaction Inducing Powders

Ti and C powders undergo exothermic reaction on heating, thereby improving wettability of metal to easily infiltrate Al of liquid phase into the preformed body. However, a synthesized reaction of titanium and carbon into TiC occurs at a high temperature of 3,343 K, so that materials having uniformly dispersed reinforcement cannot be obtained because the synthesized exothermic reaction progresses is too explosive on use of large quantities of exothermic reaction-causing powders. Meanwhile, if the amount of the powders is too small, exothermic reaction does not occur in the melt. Therefore, exothermic reaction-causing powders are limited to the amount of 20–50 wt % on preparation of the preformed body, thereby infiltrating the Al melt and not impeding dispersion of reinforced particles.

b. Amount of Diluent

The diluent does not participate in exothermic reaction within the Preformed body, but controls fast reaction properties and temperature, thereby uniformly distributing with newly produced reinforced particles.

At that time, when the diluent is TiC powders, the diluent is limited to the amount of 20–60 wt % on the basis of weight of the preformed body, depending on size and shape of particles.

c. Amount of Metal Powders

Metal powders within the preformed body have the same or similar components to the melt, so allowing the melt to easily Infiltrate into the preformed body when the preformed body is impregnated into the melt. However, if the amount of the metal powders is too large, the reinforced particles have totally reduced amounts so that viscosity within the preformed body is reduced owing to infiltration of the melt after dipping of the preformed body into the melt. That is, the reinforced particles are not uniformly dispersed therein, or parts of the preformed body overflow from the reaction container. Accordingly, Al powders are limited to the amount of 5–30 wt %.

A better understanding of the present invention may be obtained in light of the following examples which are set forth to illustrate, but are not to be construed to limit the present invention.

EXAMPLE 1

Powders having weight composition ratio of Ti:C:TiC:Al=6:24:50:20 were mixed in a ball mill. The mixed powders were pressed into a cylindrical form (diameter 20 mm, height 30 mm) as shown in FIG. 1*a*. The cylindrically preformed body was dried in a thermostat maintained at 200° C. for 8 hours or longer. The cylindrically preformed body 1 was fitted in a reaction container 2 as Illustrated in FIG. 1*b*. The container made of graphite was opened at its top and bottom, so the preformed body being able to contact with molten metals at the upper and the lower parts of the container. The preformed body 1-fitted container 2 was dipped into an Al melt 3 of 900° C. in a molter bath 4 (see, FIG. 1*c*). As such, exothermic reaction and infiltration were generated in the preformed body 1 dipped in the Al melt 3. One minute after the onset of the synthesized reaction, the container was removed from the melt. The prepared high volume reinforced composite 5 was separated from the reaction container 2. In the prepared composite 5, TiC reinforced particles were uniformly dispersed in the Al matrix. At that time, TiC reinforced particles added as a diluent coexisted with TiC reinforced particles formed by exothermic reaction.

EXAMPLE 2

30 wt % of exothermic reaction-causing powders, 50 wt % of exothermic reaction-controlling diluent powders and 20 wt % of infiltration-aiding metal powders, which comprised the preformed body, were mixed in a ball mill. At that time, as the exothermic reaction-controlling diluent powders, $TiB_2$, SiC and WC were substituted for TiC, as shown in the following table 1. The mixed powders were pressed into a cylinder (diameter 20 mm, height 30 mm), which was then fitted In the reaction container as shown in FIG. 1*b*. The preformed body-fitted container was dipped in the Al melt at 900° C. As such, exothermic reaction and infiltration was initiated in the preformed body dipped in the Al melt. One minute after the onset of the synthesized reaction, the container was removed from the melt. The prepared high volume reinforced composite was separated from the reaction container. The prepared composite materials showed TiC and $TiB_2$, TiC and SiC, TiC and WC particles uniformly dispersed in the Al matrix.

TABLE 1

| Composition of preformed body | Melt Temp. (° C.) | Matrix Structure | Reinforced Particles |
|---|---|---|---|
| Ti—C—$TiB_2$—Al | 900 | Al | TiC, $TiB_2$ |
| Ti—C—SiC—Al | 900 | Al | TiC, SiC |
| Ti—C—WC—A1 | 900 | Al | TiC, WC |

EXAMPLE 3

30 wt % of exothermic reaction-causing powders, 50 wt % of exothermic reaction-controlling diluent powders and 20 wt % of infiltration-aiding metal powders, as described in the example 2, were mixed in a ball mill. As such, as the exothermic reaction-inducing powders, Ti and B were substituted for Ti and C, as shown in the table 2, below. $TiB_2$ formed by Ti and B was known to be an excellent reinforcement because of not only having high heating value calculated from the theoretical adiabatic reaction temperature of 3,193 K, but also not reacting with the matrix metals. In addition, $TiB_2$, TiC, SiC and WC were used as the diluent powders. The mixed powders were pressed into a cylindrical form (diameter 20 mm, height 30 mm), followed by fitting in a reaction container as shown in FIG. 1*b*. The preformed body-fitted container was dipped in the Al melt of 900° C. As Such, exothermic reaction and infiltration was initiated in the preformed body dipped in the Al melt. One minute after the onset of the synthesized reaction, the container was removed from the melt. The prepared high volume reinforced composite was separated from the reaction container. The prepared composite materials showed $TiB_2$, $TiB_2$ and TiC, $TiB_2$ and SiC, $TiB_2$ and WC particles uniformly dispersed in the Al matrix.

TABLE 2

| Composition of preformed body | Melt Temp. (° C.) | Matrix Structure | Reinforced Particles |
|---|---|---|---|
| TI—B—$TiB_2$—Al | 900 | Al | $TiB_2$ |
| TI—B—TiC—Al | 900 | Al | $TiB_2$, TiC |
| Ti—B—SiC—Al | 900 | Al | $TiB_2$, SiC |
| TI—B—WC—Al | 900 | Al | $TiB_2$, W |

EXAMPLE 4

The dipping melt was prepared in the same manner as in the example 1, except that Al was replaced with Al-11 wt % Si alloy. Al-11 wt % Si alloy had better wettability than that of Al, so that the melt can be easily infiltrated into the preformed body. Thusly prepared composite materials showed fine structures in which TiC reinforced particles were uniformly dispersed in Al—Si structures.

A process for adding a diluent on mixing of powders is introduced in the preparation process of the preformed body dipped In the melt, so that reinforced particles produced by controlling high exothermic reaction conditions can be uniformly dispersed, along with added reinforced particles. Additionally, high relative density composite with low porosity can be prepared owing to improvement of wettability attributed to high temperature generated by the exothermic reaction.

FIG. 2*b* shows the result when a diluent is added on preparation of a high volume reinforced Al—TIC composite by a dipping process. From this drawing, it can be seen that carbide is regularly aligned by addition of the diluent. In addition, as shown in the photomicrograph of FIG.3,fine particles of TiC carbide are uniformly distributed.

Accordingly, in the present invention, reinforced particles formed by controlling high exothermic reaction conditions can be uniformly dispersed in the composite, together with added reinforced particles. Wettability of metal is improved due to high reaction temperature so that high relative density composite having low porosity can be prepared.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for preparing high volume reinforced Al composite by use of a dipping process, comprising the following steps of:

mixing 20–50 wt % of exothermic reaction-causing powders consisting of Ti and C or Ti and B, 20–60 wt % of exothermic reaction-controlling diluent powders, and 5–30 wt % of infiltration-aiding Al or Al alloy powders, to prepare mixture powders;

preforming the mixture powders into a predetermined shape;

fitting the preformed body in a reaction container, followed by dipping in an Al melt of 700–1,100° C., to form a synthesized composite; and separating the synthesized composite from the reaction container after removal from the Al melt, thereby yielding a high volume reinforced Al composite from the powder mixture through such exothermic synthesis in a metal melt that reinforced particles are uniformly distributed while restraining the generation of pores.

2. The method as set forth in claim 1, wherein said exothermic reaction-controlling diluent powders are selected from the group consisting of TiC, $TiB_2$, SiC, WC and mixtures thereof.

* * * * *